US006796477B2

(12) United States Patent
Chen

(10) Patent No.: US 6,796,477 B2
(45) Date of Patent: Sep. 28, 2004

(54) NAIL-HAMMERING APPARATUS

(75) Inventor: Mu-Yu Chen, Taichung (TW)

(73) Assignee: Aplus Pneumatic Corp., Taichung Hsien (TW)

( * ) Notice: Subject to any disclaimer, the term of this patent is extended or adjusted under 35 U.S.C. 154(b) by 0 days.

(21) Appl. No.: 10/391,225

(22) Filed: Mar. 18, 2003

(65) Prior Publication Data

US 2004/0084503 A1 May 6, 2004

(30) Foreign Application Priority Data

Oct. 30, 2002 (TW) ..... 91217524 U

(51) Int. Cl.[7] ..... B21J 15/28
(52) U.S. Cl. ..... 227/2; 227/131; 227/8
(58) Field of Search ..... 173/117, 114, 173/2, 14, 11; 227/2, 8, 131, 142

(56) References Cited

U.S. PATENT DOCUMENTS 4,215,297 A * 7/1980 Jacquemet ..... 318/130
4,237,987 A * 12/1980 Sherman ..... 173/117
4,553,074 A * 11/1985 Jacquemet ..... 318/130
4,799,557 A * 1/1989 Jacquemet ..... 173/91
5,398,537 A * 3/1995 Michalewski et al. ..... 72/430
5,497,555 A * 3/1996 Averbukh ..... 30/362
5,760,552 A * 6/1998 Chen et al. ..... 318/122
6,364,193 B1 * 4/2002 Tsai ..... 227/131
6,454,021 B1 * 9/2002 Watanabe ..... 173/114
6,502,008 B2 * 12/2002 Maurer et al. ..... 700/175
6,520,269 B2 * 2/2003 Geiger et al. ..... 173/117
6,526,852 B2 * 3/2003 Rahmsdorf et al. ..... 81/464

* cited by examiner

*Primary Examiner*—John Sipos
*Assistant Examiner*—Louis Tran
(74) *Attorney, Agent, or Firm*—Charles E. Baxley

(57) ABSTRACT

A nail-hammering apparatus includes a hammer, a first solenoid, a second solenoid and a control device. The hammer can hammer a nail into a workpiece. The first solenoid can be turned on so as to drive the hammer. The second solenoid can be turned on in order to drive the hammer after the first solenoid. The spring tends to bias the hammer to its original position when the second solenoid is turned off. If the nail has not entirely enters the workpiece, the control device turns on the second solenoid so as to drive the hammer one more time.

13 Claims, 4 Drawing Sheets

NAIL-HAMMERING APPARATUS

BACKGROUND OF INVENTION

1. Field of Invention

The present invention relates to a nail stapler and, more particularly, to a nail-hamming apparatus of a nail stapler.

2. Related Prior Art

Taiwanese Patent Publication No. 465170 discloses conventional nail-hammering apparatus with a hammer 10, a first solenoid L1 for driving the hammer and a second solenoid L2 for driving the hammer 10 after the first solenoid L1. More particularly, this document is related to a best timing for the turning on and off the first solenoid L1 and the second solenoid L2 in order to achieve a greatest impact that the hammer 10 can exert on a nail. However, this conventional nail-hammering apparatus does not ensure the nail entirely enters the workpiece.

The present invention is therefore intended to obviate or at least alleviate the problems encountered in prior art.

SUMMARY OF INVENTION

It is the primary objective of the present invention to provide a hammer for keeping on hammering a nail until the nail entirely enters a workpiece.

According to the present invention, a nail-hammering apparatus includes a hammer, a first solenoid, a second solenoid and a control device. The hammer can hammer a nail into a workpiece. The first solenoid can be turned on so as to drive the hammer. The second solenoid can be turned on in order to drive the hammer after the first solenoid. The spring tends to bias the hammer to its original position when the second solenoid is turned off. If the nail has not entirely enters the workpiece, the control device turns on the second solenoid so as to drive the hammer one more time.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
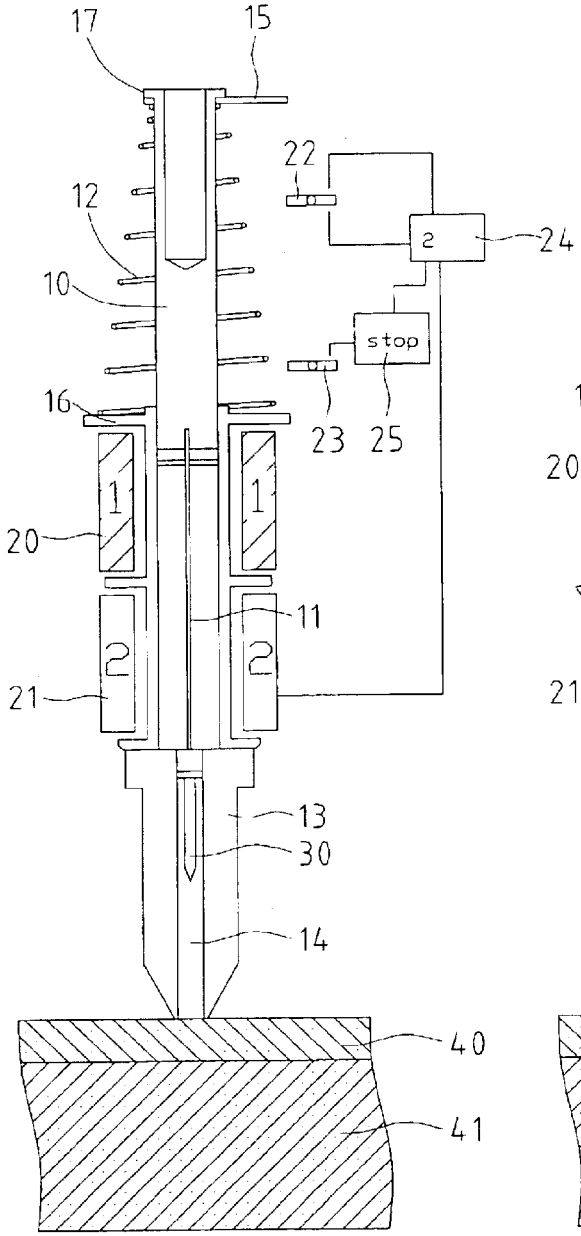
FIG. 1 is a cross-sectional view of a nail-hammering apparatus according to the preferred embodiment of the present invention, showing the hammer driven via a coil.

Referring to the drawings, a nail-hammering apparatus according to the preferred embodiment of the present invention is shown.

Referring to FIG. 1, the nail-hammering apparatus includes a cylinder 16 and a hammer 10 that can enter the cylinder 16. A pin 11 is secured to an end of the hammer 10. The pin 11 is parallel to the hammer 10. A contact 15 is secured to an opposite end of the hammer 10. The contact 15 is perpendicular to the hammer 10. A spring 12 is mounted on the hammer 10. The spring 12 is compressed between an annular flange 17 formed on the hammer 10 and the cylinder 16. A nozzle 13 is located below cylinder 16. The nozzle 13 defines a hole 14 in which the pin 11 can hammer a nail 30.

A first solenoid 20 and a second solenoid 21 are both mounted on the cylinder 16. In operation, the first solenoid 20 and the second solenoid 21 are turned on in sequence in order to drive the hammer 10.

A first sensor 22 is connected with a first circuit board 24, and a second sensor 23 with a second circuit board 25. The first sensor 22 is connected with the second sensor 23. Furthermore, the first circuit board 24 is connected with the second solenoid 21. The first sensor 22 and the second sensor 23 are located so that they can contact the contact 15.

Referring to FIG. 1, the first solenoid 20 is turned on so as to drive the hammer 10. The second solenoid 20 is kept idle.

Figure 2:
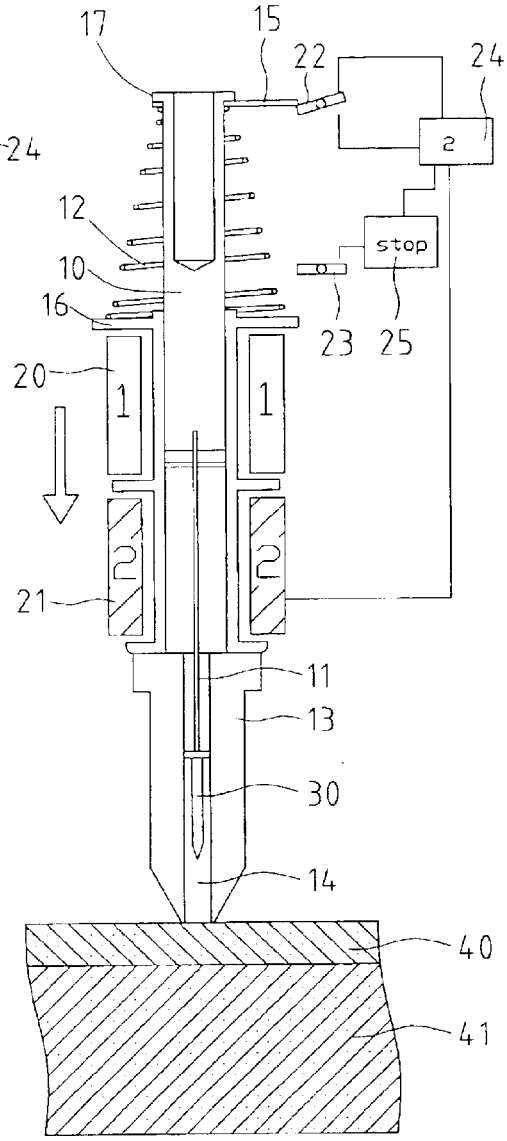
FIG. 2 is similar to FIG. 1 but showing the hammer driven via a second coil.

Referring to FIG. 2, the first solenoid 20 is turned off, and the second solenoid 21 is turned on in order to drive the hammer 10.

Figure 3:
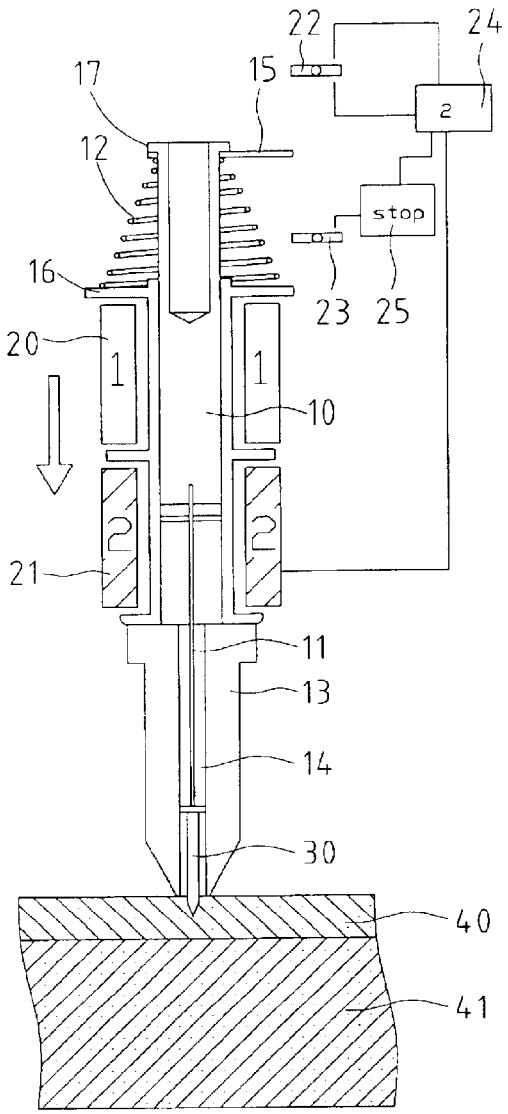
FIG. 3 is similar to FIG. 2 but showing the hammer starting to hammer a nail into a layer of workpiece.

Referring to FIG. 3, the second solenoid 21 is on, the pin 11 starts to hammer the nail 30 into a first layer of workpiece 40.

Figure 4:
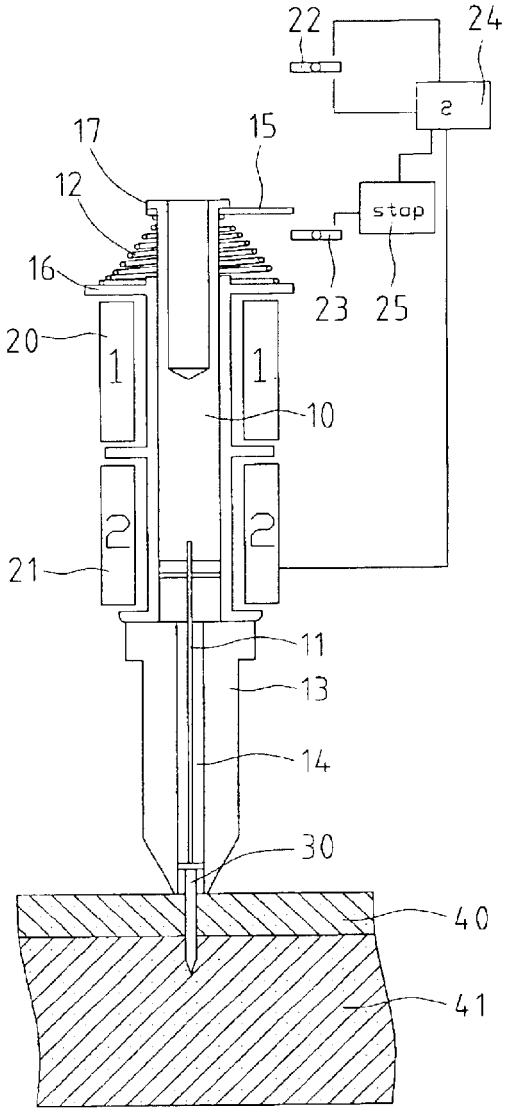
FIG. 4 is similar to FIG. 3 but showing the nail hammered into a second layer of workpiece through the first layer of workpiece.

Referring to FIG. 4, the second solenoid 21 is off, the pin 11 hammers the nail 30 into a second layer of workpiece 41 through the first layer of workpiece. However, the nail 30 has not been entirely hammered into the first layer of workpiece 40 and the second layer of workpiece 41. Accordingly, the contact 15 has not contacted the second sensor 23. Therefore, no signal is sent from the second circuit board 25 to the first circuit board 24.

Figure 5:
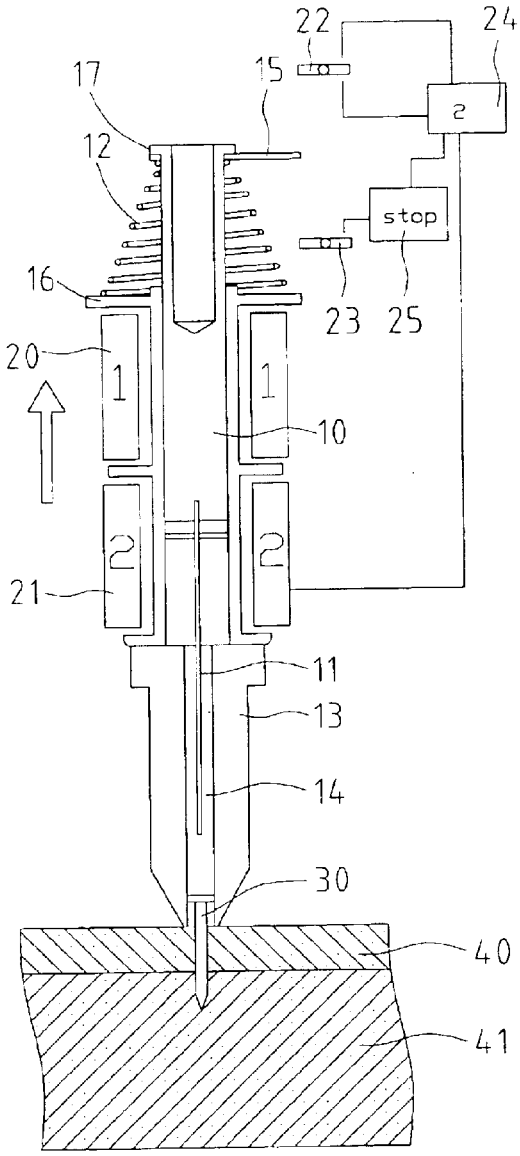
FIG. 5 is similar to FIG. 4 but showing the hammer turned to its original position via a spring.

Referring to FIG. 5, the spring 12 is turning the pin 11 to its original position.

Figure 6:
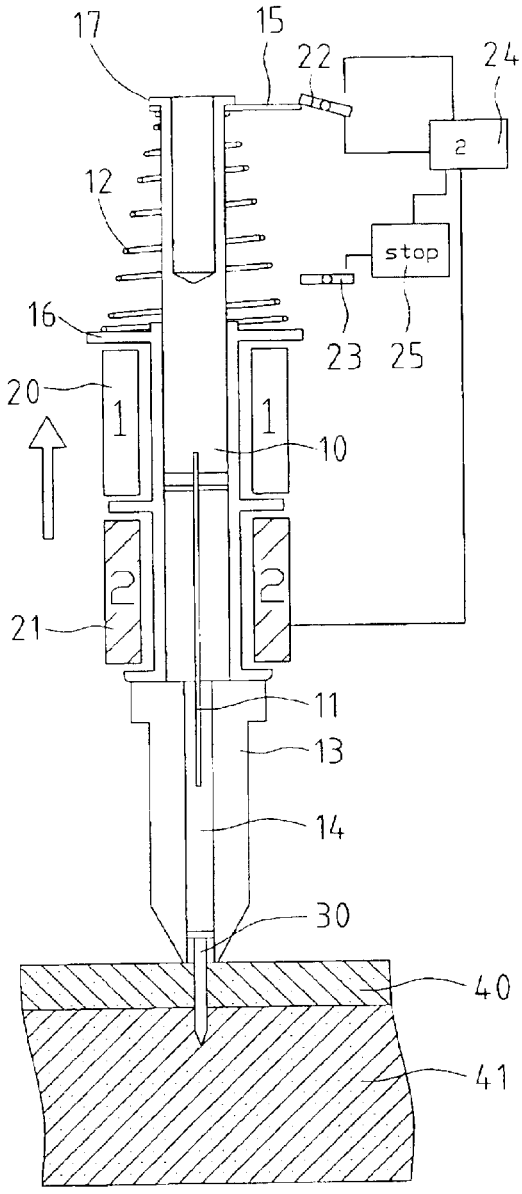
FIG. 6 is similar to FIG. 5 but showing the hammer driven via the second coil.

Referring to FIG. 6, the contact 15 has contacted the first sensor 22. On receiving a signal from the first sensor 22 while receiving no signal from the second circuit board 25, the first circuit board 24 turns on the second solenoid 21. Thus, the second coil 21 drives the hammer 10 again.

Figure 7:
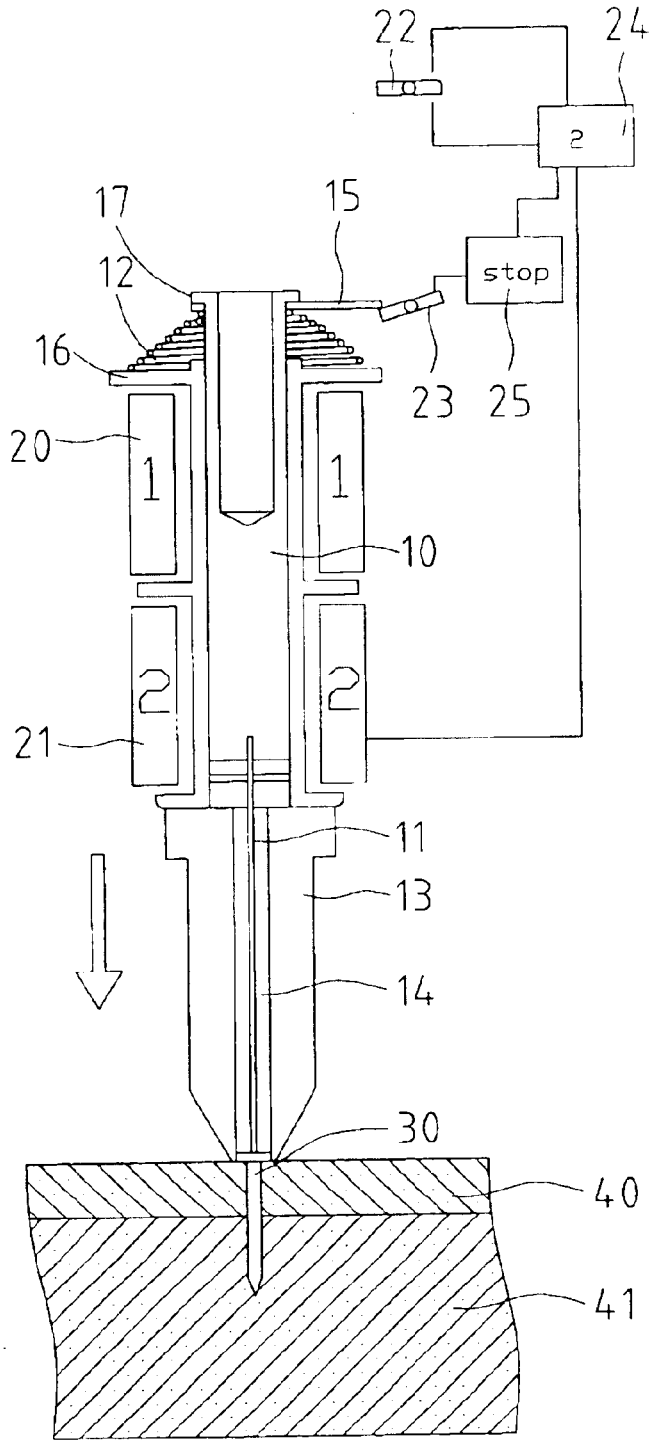
FIG. 7 is similar to FIG. 6 but showing the nail entirely hammered into the first layer of workpiece and the second layer of workpiece.

Referring to FIG. 7, the nail 30 has been entirely hammered into the first layer of workpiece 40 and the second layer of workpiece 41. Accordingly, the contact 15 contacts the second sensor 23. Thus, a STOP signal for is sent to the first circuit board 24 through the second circuit board 25. After receiving the STOP signal, the first circuit board 24 will not turn on the second solenoid 21.

The present invention has been described via illustration of the preferred embodiment. Those skilled in the art can derive variations from the preferred embodiment without departing from the scope of the present invention. Hence, the preferred embodiment shall not limit the scope of the present invention defined in the claims.

What is claimed is:

1. A nail-hammering apparatus including:

a hammer for hammering a nail into a workpiece;

a first solenoid that can be turned on so as to drive the hammer;

a second solenoid that can be turned on in order to drive the hammer after the first solenoid;

a spring for biasing the hammer to its original position when the second solenoid is turned off; and a control device for turning on the second solenoid so as to drive the hammer if the nail has not entirely entered the workpiece wherein the control device includes a sensor for sensing the presence of the hammer and producing a STOP signal so as to prevent the control device from driving the hammer if the hammer hammers the nail entirely into the workpiece.

2. The nail-hammering apparatus according to claim 1 wherein the control device includes a circuit board connected with the sensor.

3. The nail-hammering apparatus according to claim 1 wherein the control device includes an upper sensor for sensing the presence of the hammer and turning on the second solenoid if the lower sensor does not produce a STOP signal.

4. The nail-hammering apparatus according to claim 3 wherein the control device includes a circuit board connected with the upper sensor.

5. The nail-hammering apparatus according to claim 3 wherein the control device includes a circuit board connected with both the first sensor and the second sensor.

6. The nail-hammering apparatus according to claim 1 wherein the control device includes a contact secured to the hammer for contacting the sensor.

7. The nail-hammering apparatus according to claim 6 wherein the contact is perpendicular to the hammer.

8. The nail-hammering apparatus according to claim 1 wherein the control device includes:

a lower sensor for sensing the presence of the hammer and producing a STOP signal so as to prevent the control device from driving the hammer if the hammer hammers the nail entirely into the workpiece; and an upper sensor for sensing the presence of the hammer and turning on the second solenoid if the lower sensor does not produce a STOP signal.

9. The nail-hammering apparatus according to claim 8 wherein the control device includes a circuit board connected with the lower sensor.

10. The nail-hammering apparatus according to claim 8 wherein the control device includes a circuit board connected with the upper sensor.

11. The nail-hammering apparatus according to claim 8 wherein the control device includes a circuit board connected with both the lower sensor and the upper sensor.

12. The nail-hammering apparatus according to claim 8 wherein the control device includes a contact secured to the hammer for contacting the lower sensor and the upper sensor.

13. The nail-hammering apparatus according to claim 12 wherein the contact is perpendicular to the hammer.

* * * * *